US005103481A

United States Patent [19]

Iseda et al.

[11] Patent Number: 5,103,481

[45] Date of Patent: Apr. 7, 1992

[54] VOICE DETECTION APPARATUS

[75] Inventors: Kohei Iseda, Kawasaki; Kenichi Abiru, Yokohama; Yoshihiro Tomita, Itabashi; Shigeyuki Unagami, Atsugi, all of Japan

[73] Assignee: Fujitsu Limited, Kawasaki, Japan

[21] Appl. No.: 507,658

[22] Filed: Apr. 10, 1990

[30] Foreign Application Priority Data

Apr. 10, 1989 [JP] Japan ..... 1-90036

[51] Int. Cl.[5] ..... G10L 5/00

[52] U.S. Cl. ..... 381/46

[58] Field of Search ..... 381/41–47, 381/71, 94; 364/513.5

[56] References Cited

U.S. PATENT DOCUMENTS

| | | | |
|---|---|---|---|
| 4,061,878 | 12/1977 | Adoul et al. | 381/46 |
| 4,281,218 | 7/1981 | Chuang et al. | 381/46 |
| 4,688,256 | 8/1987 | Yasunaga | 381/46 |
| 4,696,040 | 9/1987 | Doddington et al. | 381/46 |
| 4,700,394 | 10/1987 | Selbach et al. | 381/46 |
| 4,918,734 | 4/1990 | Muramatsu et al. | 381/46 |

*Primary Examiner*—Emanuel S. Kemeny
*Attorney, Agent, or Firm*—Staas & Halsey

[57] ABSTRACT

Speech presence versus silence is decided by a discriminator which can use a certain combination of parameter values: signal power, prediction error power, prediction error power deviation, and zero crossings.

19 Claims, 12 Drawing Sheets

Xi
$SP = \frac{1}{N}\sum_{i=1}^{n} Xi^2$
11
SIGNAL POWER

12
Xi
21
HPF
22
POLARITY DETECTION
23
1-SAMPLE DELAY
24
POLARITY INVERSION DETECTION
25
COUNTER
ZERO CROSSING NO.
RST

S41
START

S42
P ≧ Pth ?
YES
S43
VOICED
NO
S44
Z ≧ Zth ?
YES
S45
PSEUDO VOICED
NO
S46
D ≧ Dth ?
YES
NO
S47
INVERT STATE OF PREVIOUS FRAME
PREVIOUS FRAME VOICED
PREVIOUS FRAME SILENT
S50
0 ≦ |G| ≦ Gth ?
NO
YES
S52
SILENT
S51
MAINTAIN STATE OF PREVIOUS STATE
PREVIOUS FRAME VOICED
PREVIOUS FRAME SILENT
S48
PSEUDO VOICED
S49
SILENT

S45/S48
PSEUDO VOICED
S61
P ≧ Pth* ?
NO
YES
S62
SILENT
S63
VOICED

VOICE DETECTION APPARATUS

BACKGROUND OF THE INVENTION

The present invention generally relates to voice detection apparatuses, and more particularly to a voice detection apparatus for detecting voiced and silent intervals of a voice signal.

Recently, there are increased demands to design a communication system which can make an efficient data transmission by use of a high-speed channel such as a high-speed packet and ATM. In such a communication system, the data transmission is controlled depending on the existence of the voice signal so as to realize the efficient data transmission. For example, a control is carried out to compress the transmission data quantity by not transmitting the signal in the voiceless interval of the voice signal. Accordingly, in order to realize the efficient data transmission, it is essential that the voiced and silent intervals of the voice signal are detected by a voice detection apparatus with a high accuracy.

FIG. 1 shows an example of a conventional voice detection apparatus which comprises a signal power calculation part 1, a zero crossing counting part 2 and a discriminating part 3. The signal power calculation part 1 extracts a voice signal for every frame and calculates a voice signal power. The zero crossing counting part 2 counts a number of times the polarity of the voice signal is inverted. The discriminating part 3 discriminates voiced and silent intervals of the voice signal based on outputs of the signal power calculation part 1 and the zero crossing counting part 2.

FIG. 2 is a flow chart for explaining the operation of the discriminating part 3 of the voice detection apparatus. A step S0 discriminates whether or not a voice signal power SP calculated in the signal power calculation part 1 is greater than a threshold value $SP_{th}$. When the discrimination result in the step S0 is YES, a voiced interval is detected and a step S1 sets the threshold value $SP_{th}$ to $SP_{th}=SP_{th2}$ and the process returns to the step S0. On the other hand, when the discrimination result in the step S0 is NO, a step S2 compares a zero crossing number ZC which is counted in the zero crossing counting part 2 with threshold values $ZC_v$ and $ZC_f$.

FIG. 3 shows a relationship of the threshold values $ZC_v$ and $ZC_f$, the voiced interval (voiced and voiceless sounds) and the silent interval (noise). It is known that the silent interval occurs only when $ZC_v<ZC<ZC_f$. Accordingly, when $ZC>ZC_f$ and $ZC<ZC_v$ and the voiced interval is detected in the step S2, the process returns to the step S0 via the step S1. However, when $ZC_f>ZC>ZC_v$ and the silent interval is detected in the step S2, a step S3 sets the threshold value $SP_{th}$ to $SP_{th}=SP_{th1}$ and the process returns to the step S0.

FIG. 4 shows a relationship of the threshold values $SP_{th1}$ and $SP_{th2}$. A hysteresis characteristic is given to the threshold values at the times when the voiced and silent intervals are detected, and the threshold value is set to $SP_{th1}$ for the transition from the silent interval to the voiced interval and the threshold value is set to $SP_{th2}$ for the transition from the voiced interval to the silent interval, so that no chattering is generated in the detection result.

However, the response of this conventional voice detection apparatus is poor because the voiced and silent intervals are detected based solely on the signal power and the zero crossing number. For this reason, there is a problem in that a beginning of speech and an end of speech cannot be detected accurately.

In order to eliminate this problem, the conventional voice detection apparatus stores the voice signal for a predetermined time, and the stored data is read out when the voiced interval is detected so as to avoid a dropout at the beginning of the speech. In addition, in the case of the end of speech, the voiced interval is deliberately continued for a predetermined time so as to eliminate a dropout at the end of speech. But because a delay element is provided to prevent the dropout of the voice data, there are problems in that a delay is inevitably introduced in the voice detection operation and the provision of the delay element is undesirable when considering the structure of a coder which is used in the voice detection apparatus.

SUMMARY OF THE INVENTION

Accordingly, it is a general object of the present invention to provide a novel and useful voice detection apparatus in which the problems described above are eliminated.

Another and more specific object of the present invention is to provide a voice detection apparatus comprising signal power calculation means for calculating a signal power of an input voice signal for each frame of the input voice signal. Zero crossing counting means counts a number of polarity inversions of the input voice signal for each frame of the input voice signal, while prediction filter means obtains a prediction error signal of the input voice signal based on the input voice signal. Error signal power calculation means calculates a signal power of the prediction error signal which is received from the adaptive prediction filter means, and power comparing means compares the signal powers of the input voice signal and the prediction error signal and obtains a power ratio between the two signal powers. Finally discriminating means discriminates voiced an silent intervals of the input voice signal based on the signal power calculated in the signal power calculation means, the number of polarity inversions counted in the zero crossing counting means and the power ratio obtained in the power comparing means. The discriminating means includes first means for discriminating the voiced and silent intervals of the input voice signal based on the number of polarity inversions, and second means for comparing an absolute value of a difference of power ratios between frames with a first threshold value. The second means also discriminates in addition to the discrimination of the first means whether a present frame is a voiced interval or a silent interval depending on whether a previous frame is a voiced interval or a silent interval when the signal power of the input voice signal is less than a second threshold value. According to the voice detection apparatus of the present invention, it is possible to detect the voiced and silent intervals of the input voice signal with a high accuracy, without the need of complicated circuitry.

Still another object of the present invention is to provide a voice detection apparatus comprising signal power calculation means for calculating a signal power of an input voice signal for each frame of the input voice signal. Zero crossing counting means counts a number of polarity inversions of the input voice signal for each frame of the input voice signal, while prediction gain deviation calculation means calculates a prediction gain and a prediction gain deviation between present and previous frames based on the input voice signal and the signal power calculated in the signal power calculation means. Discriminating means discriminates voiced and silent intervals of the input voice signal based on the signal power calculated in the signal power calculation means, the number of polarity inversions counted in the zero crossing counting means and the prediction gain and the prediction gain deviation calculated in the prediction gain deviation calculation means. The discriminating means includes first means for discriminating the voiced and silent intervals of the input voice signal based on the signal power and the number of polarity inversions when the signal power is greater than or equal to a first threshold value and the number of polarity inversions falls outside a predetermined range of a second threshold value. Second means of the discriminating means discriminates the voiced and silent intervals of the voiced signal based on a comparison of the prediction gain deviation and a third threshold value when the signal power is less than the first threshold value and the number of polarity inversions falls within the predetermined range of the second threshold value. According to the voice detection apparatus of the present invention, it is possible to detect the voiced and silent intervals of the input voice signal with a high accuracy.

A further object of the present invention is to provide a voice detection apparatus for detecting voiced and silent intervals of an input voice signal for each frame of the input voice signal, comprising prediction gain detection means which receives the input voice signal for detecting a prediction gain for a present frame of the input voice signal. Prediction gain deviation detection means receives the input voice signal for detecting a prediction gain deviation between the present frame while a previous frame, and discriminating means respectively compares the prediction gain from the prediction gain detection means and the prediction gain deviation from the prediction gain deviation detection means with first and second threshold values and for discriminating whether the present frame of the input voice signal is a voiced interval or a silent interval based on the comparisons. According to the voice detection apparatus of the present invention, it is possible to accurately discriminate the voiced and silent intervals of the input voice signal even when the prediction gain deviation is small such as the case where the background noise level is large and a transition occurs between the voiced and silent states. For this reason, it is possible to greatly improve the reliability of the voice detection.

Other objects and further features of the present invention will be apparent from the following detailed description when read in conjunction with the accompanying drawings. cl BRIEF DESCRIPTION OF THE DRAWINGS FIG. 1 is a system block diagram showing an example of a conventional voice detection apparatus;

DESCRIPTION OF THE PREFERRED EMBODIMENTS

Figure 5:
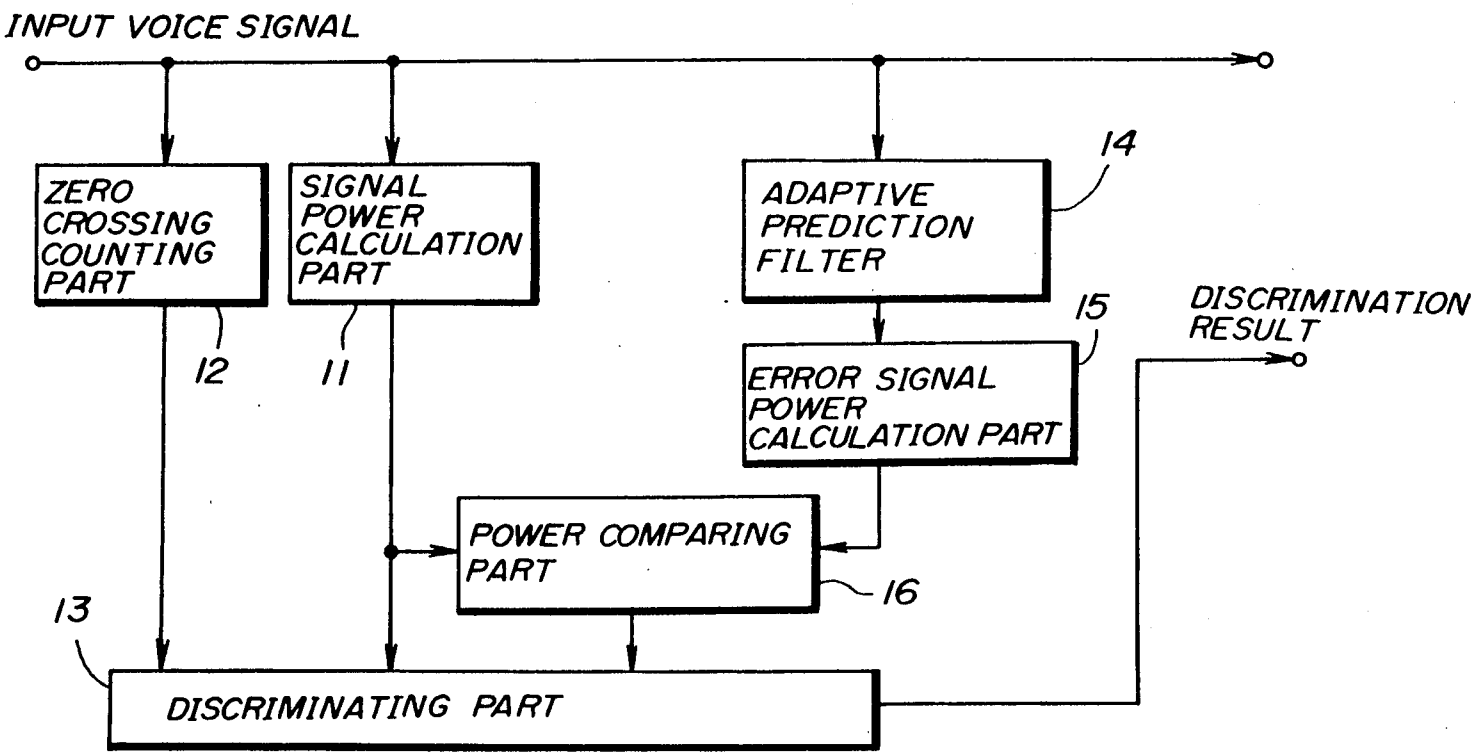
FIG. 5 is a system block diagram for explaining an operating principle of a first embodiment of a voice detection apparatus according to the present invention.

A description will be given of an operating principle of a first embodiment of a voice detection apparatus according to the present invention, by referring to FIG. 5. The voice detection apparatus shown in FIG. 5 comprises a signal power calculation part 11, a zero crossing counting part 12, a discriminating part 13, an adaptive prediction filter 14, an error signal power calculation part 15 and a power comparing part 16. The adaptive prediction filter 14 obtains a prediction error signal of an input voice signal. The error signal power calculation part 15 obtains the power of the prediction error signal. The power comparing part 16 obtains a power ratio of the input voice signal power and the prediction error signal power. In addition to the discrimination of the voiced/silent interval based on a zero crossing number which is obtained in the zero crossing counting part 12, the discriminating part 13 compares an absolute value of a difference of the power ratios between frames with a threshold value and also discriminates the voiced/silent state of a present frame depending on whether a previous frame is voiced or silent when the input voice signal power is smaller than a threshold value.

In other words, this embodiment uses the following voice detection method in addition to making the voice detection based on the voice signal power and the zero crossing number which are respectively obtained from the signal power calculation part 11 and the zero crossing counting part 12.

That is, when the input voice signal power is smaller than a threshold value, the power comparing part 16 obtains the power ratio of the input voice signal power, which is received from the signal power calculation part 11, and the prediction error signal power which is received from the error signal power calculation part 15 which receives the prediction error signal from the adaptive prediction filter 14, at the same time as the discrimination of the voiced/silent interval based on the zero crossing number. The discriminating part 13 obtains an absolute value of a difference of the power ratios between frames and compares this absolute value with a threshold value. The discriminating circuit 13 discriminates whether the present frame is voiced or silent depending on whether the absolute value is smaller or larger than the threshold value and also whether the voiced/silent state is detected in the previous frame.

Accordingly, it is possible to detect from the power ratio a rapid increase or decrease in the prediction errors between frames. By taking into account the rapid increase or decrease in the prediction errors between the frames and the discrimination result on the voiced/silent state of the previous frame, it is possible to quickly and accurately discriminate the voiced/silent state of the present frame.

Figure 6:
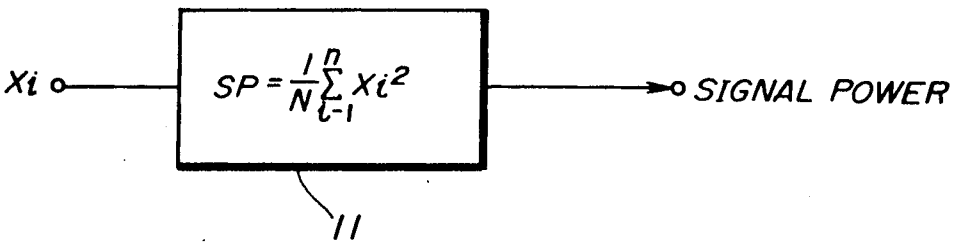
FIG. 6 shows an embodiment of a signal power calculation part of the first embodiment.
Figure 7:
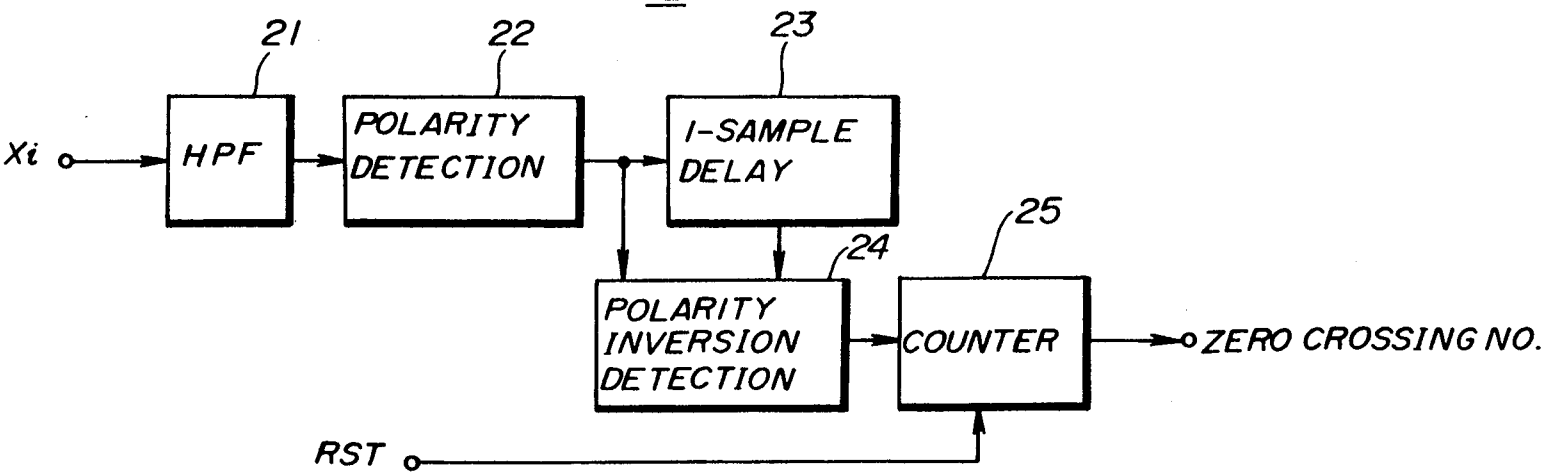
FIG. 7 is a system block diagram showing an embodiment of a zero crossing counting part of the first embodiment.
Figure 8:
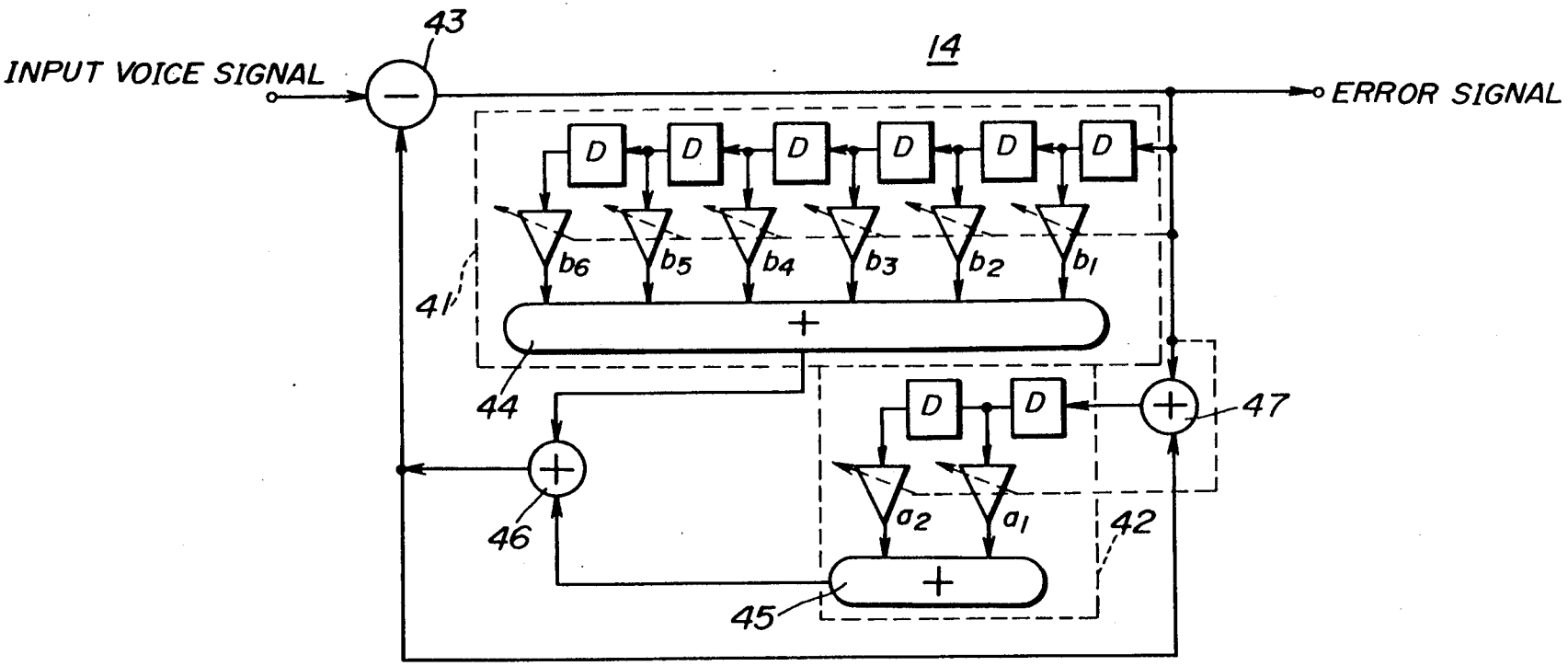
FIG. 8 is a system block diagram showing an embodiment of an adaptive prediction filter of the first embodiment.

FIG. 6 shows an embodiment of the signal power calculation part 11. FIG. 7 shows an embodiment of the zero crossing counting part 12. FIG. 8 shows an embodiment of the adaptive prediction filter 14.

In FIG. 6, an input voice signal power SP is given by the following formula based on an input voice signal $x_i$.

$$SP = (1/N) \sum_{i-1}^{n} X_i^2$$

In the above formula, n denotes a number of samples, and N denotes a number of frames which is obtained by sectioning the input voice signal $x_i$ at predetermined time intervals.

In FIG. 7, the zero crossing counting part 12 comprises a highpass filter 21, a polarity detection part 22, a 1-sample delay part 23, a polarity inversion detection part 24 and a counter 25. The input voice signal $x_i$ is supplied to the highpass filter 21 to eliminate a D.C. offset. The polarity detection part 22 detects the polarity of the input voice signal $x_i$. The polarity inversion detection part 24 receives the input voice signal $x_i$ from the polarity detection part 22 and a delayed input voice signal $x_i$ which is delayed by one sample in the 1-sample delay part 23. The polarity inversion detection part 24 detects the polarity inversion based on a present sample and a previous sample of the input voice signal $x_i$. The counter 25 counts the number of polarity inversions detected by the polarity inversion detection part 24. The counter 25 is reset for every frame in response to a reset signal RST.

The adaptive prediction filter 14 shown in FIG. 8 corresponds to an adaptive prediction filter which is often used in an ADPCM coder but excluding a quantizer and an inverse quantizer. The adaptive prediction filter 14 comprises an all zero type filter 41 and an all pole type filter 42. The all zero type filter 41 comprises six sets of delay parts D and taps b1 through b6, and the all pole type filter 42 comprises two sets of delay parts D and taps a1 and a2. The adaptive prediction filter 14 additionally comprises a subtracting part 43, and adding parts 44 through 47 which are connected as shown.

Figure 1:
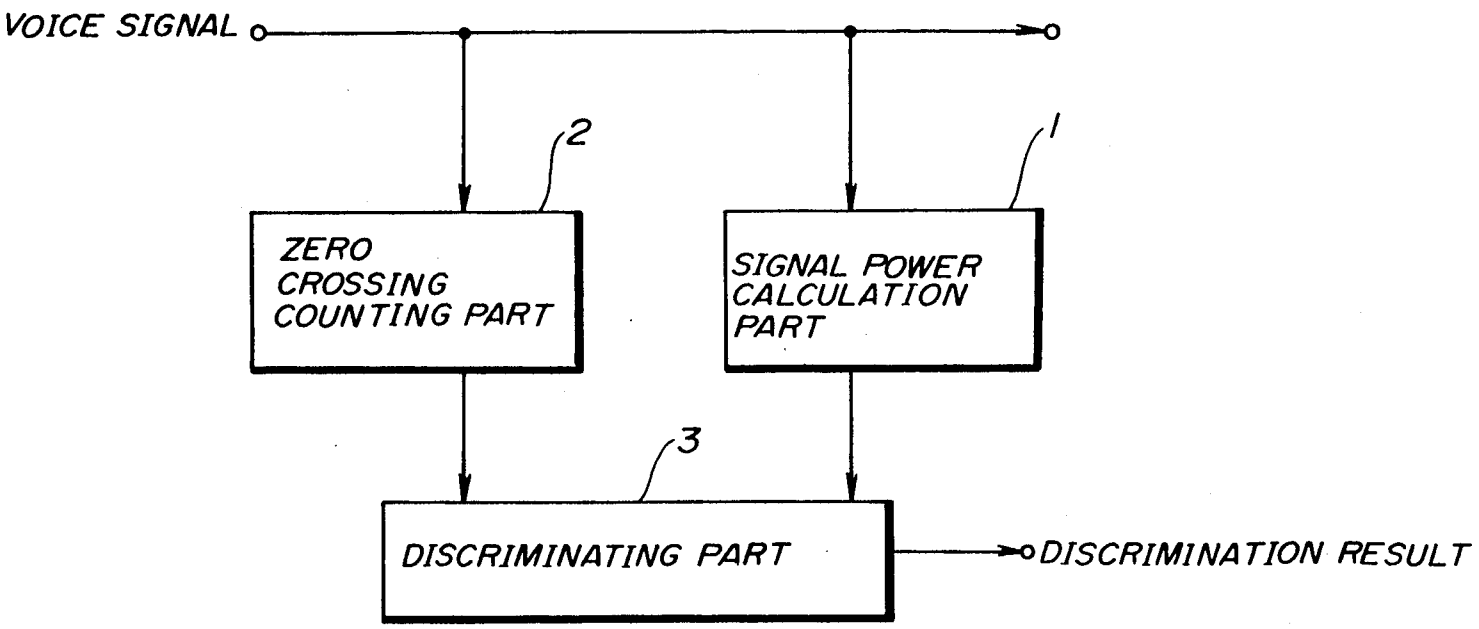
FIG. 1 PRIOR ART
Figure 2:
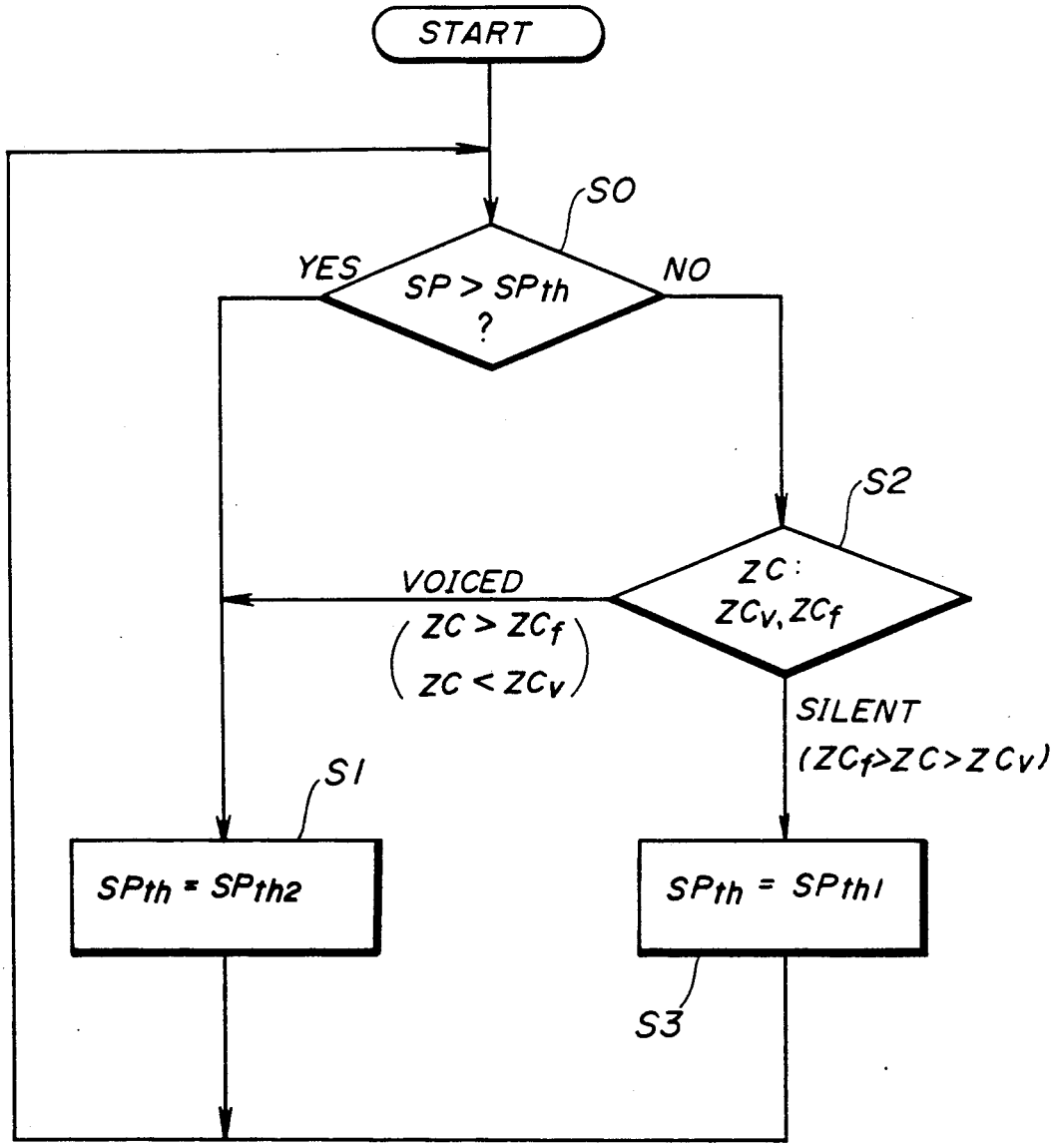
FIG. 2 PRIOR ART
FIG. 2 is a flow chart for explaining an operation of a discriminating part of the voice detection apparatus shown in FIG. 1.
Figure 3:
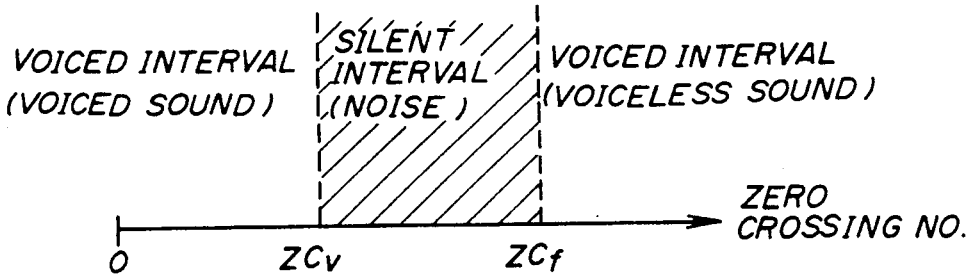
FIG. 3 PRIOR ART
FIG. 3 shows a relationship of threshold values and voiced and silent intervals.
Figure 4:
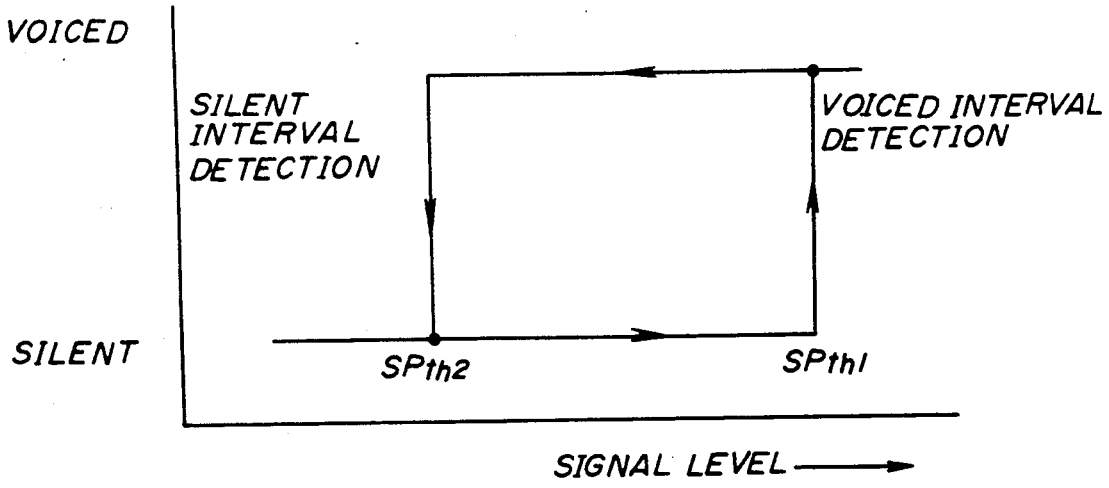
FIG. 4 PRIOR ART
FIG. 4 is a diagram for explaining a method of discriminating the voiced or silent interval based on a signal power.
Figure 9:
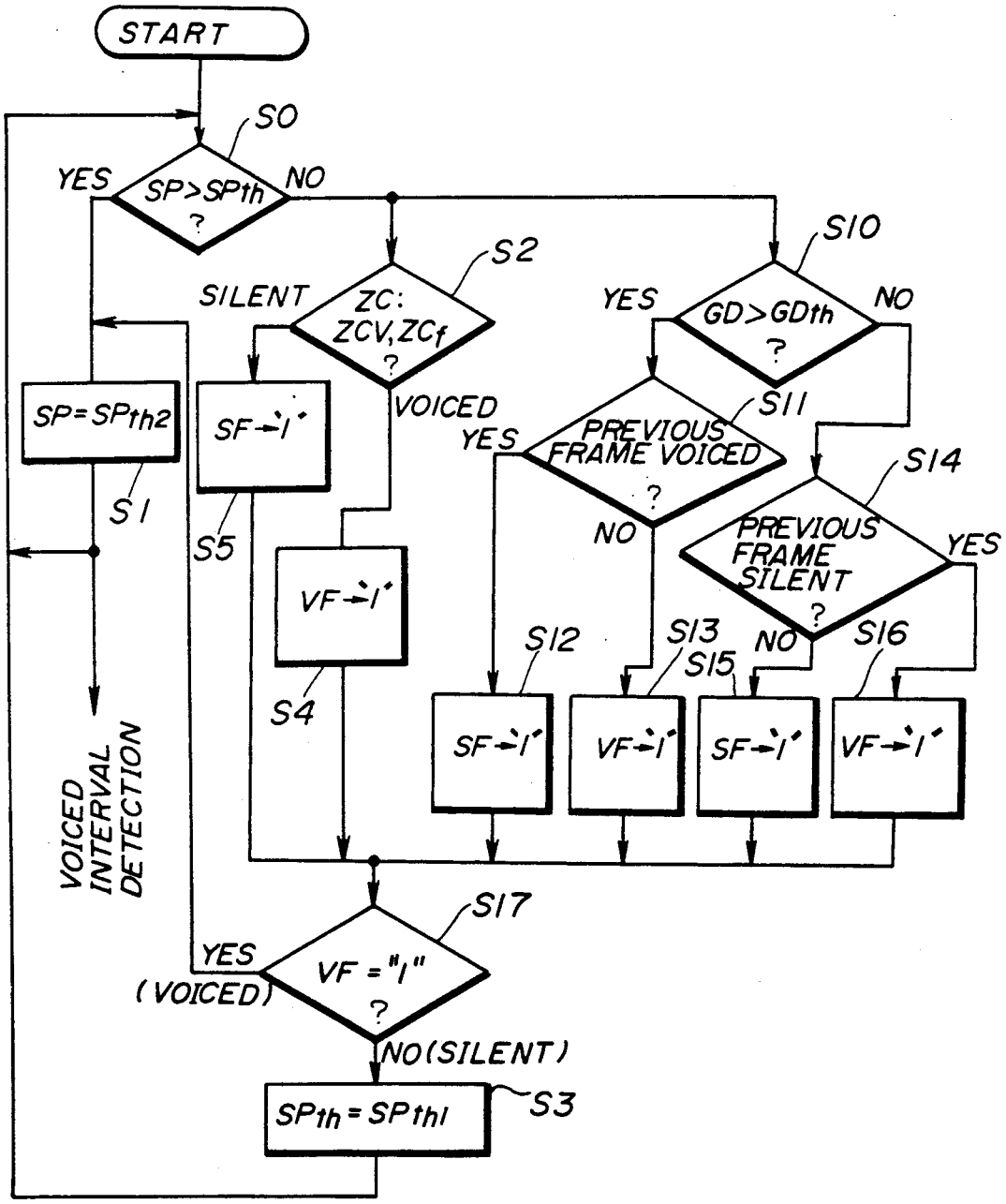
FIG. 9 is a flow chart for explaining an operation of a discriminating part of the first embodiment.

Next, a description will be given of an operation of the discriminating part 13, by referring to a flow chart shown in FIG. 9. In FIG. 9, those steps which are substantially the same as those corresponding steps in FIG. 2 are designated by the same reference numerals, and a description thereof will be omitted.

When the discrimination result in the step S0 is NO, a step S10 is carried out at the same time as the step S2. The steps S10 through S17 discriminate the voiced/silent state based on the power ratio which is obtained from the power comparing part 16.

When the step S2 detects the voiced state, a step S4 sets a voiced flag VF to "1". On the other hand, a step S5 sets a silent flag SF to "1" when the step S2 detects the silent state. The step S17 discriminates whether or not the voiced flag VF is "1". The voiced state is detected when the discrimination result in the step S17 is YES, and the silent state is detected when the discrimination result in the step S17 is NO. The process advances to the step S1 when the discrimination result in the step S17 is YES. The process advances to the step S3 when the discrimination result in the step S17 is NO.

The discriminating part 13 obtains in the following manner a prediction gain G. The prediction gain G is the power ratio between the prediction error signal power EP which is obtained from the error signal power calculation part 15 and the input voice signal power SP which is obtained from the signal power calculation part 11.

$$G = 10\log_{10}(SP/EP)$$

In addition, the discriminating part 13 calculates a difference (or change) GD of the prediction gains G between the frames according to the following formula, where t denotes the frame.

$$GD = |G_t - G_{t-1}|$$

In this case, the absolute value of $G_t - G_{t-1}$ is calculated because the power may change from a large value to a small value or vice versa between the frames.

The step S10 discriminates whether or not the difference GD of the prediction gains F between the frames is greater than a preset threshold value $GD_{th}$. When the discrimination result in the step S10 is YES, a step S11 discriminates whether or not the previous frame is a voiced interval by referring to the voiced/silent discrimination information which is stored in the previous frame. When the discrimination result in the step S11 is YES, it is discriminated that the previous frame is silent and a step S12 sets the silent flag SF to "1". On the other hand, when the discrimination result in the step S11 is NO, it is discriminated that the previous frame is a voiced interval and a step S13 sets the voiced flag VF to "1".

On the other hand, when the discrimination result in the step S10 is NO, a step S14 discriminates whether or not the previous frame is a silent interval by referring to the voiced/silent discrimination information which is stored in the previous frame. When the discrimination result in the step S14 is NO, it is discriminated that the previous frame is silent and a step S15 sets the silent flag SF to "1". On the other hand, when the discrimination result in the step S14 is YES, it is discriminated that the previous frame is a voiced interval and a step S16 sets the voiced flag VF to "1".

The discrimination result is stored in the voiced and silent flags VF and SF in the above described manner in the steps S4, S5, S12, S13, S15 and S16. When the voiced flag VF is set to "1", the discrimination result in the step S17 is YES and the voiced interval is detected. In this case, the threshold value $SP_{th}$ of the signal power SP is renewed in the step S1. On the other hand, when no voiced flag is set to "1", the discrimination result in the step S17 is NO and the silent interval is detected. In this case, the threshold value $SP_{th}$ of the signal power SP is renewed in the step S3.

When the voiced interval is detected, the discriminating part 13 generates a voiced interval detection signal which is used as a switching signal for switching the transmission between voice and data.

Figure 10:
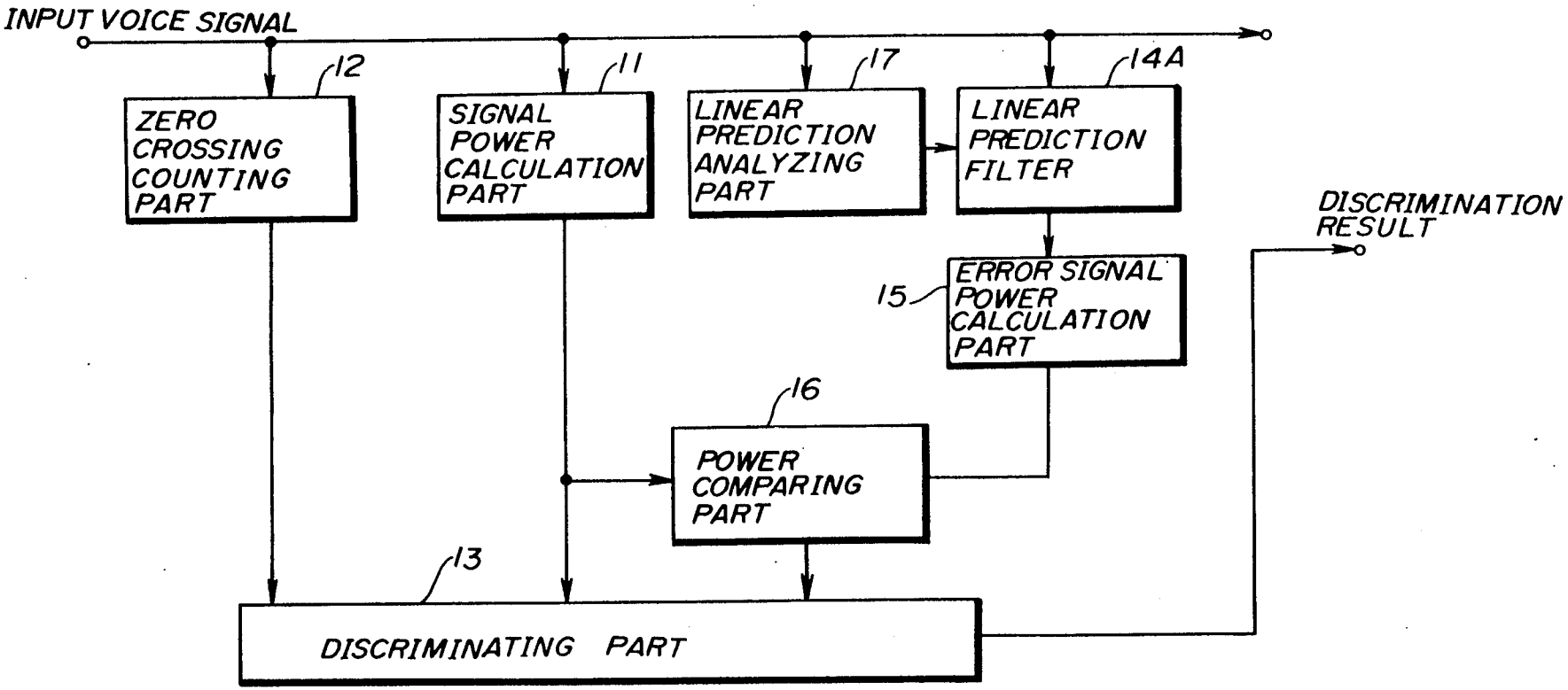
FIG. 10 is a system block diagram showing a second embodiment of the voice detection apparatus according to the present invention.

Next, a description will be given of a second embodiment of the voice detection apparatus according to the present invention, by referring to FIG. 10. In FIG. 10, those parts which are substantially the same as those corresponding parts in FIG. 5 are designed by the same reference numerals, and a description thereof will be omitted.

In this embodiment, a linear prediction filter 14A is used for the adaptive prediction filter 14, and a linear prediction analyzing part 17 is provided to obtain a prediction coefficient based on the input voice signal. The prediction coefficient obtained by the linear prediction analyzing part 17 is supplied to the linear prediction filter 14A. Because the prediction coefficient can be obtained beforehand by the linear prediction analyzing part 17 using the data of a previous frame, it is possible to speed up the calculation of the prediction error and make the prediction more accurate.

Figure 11:
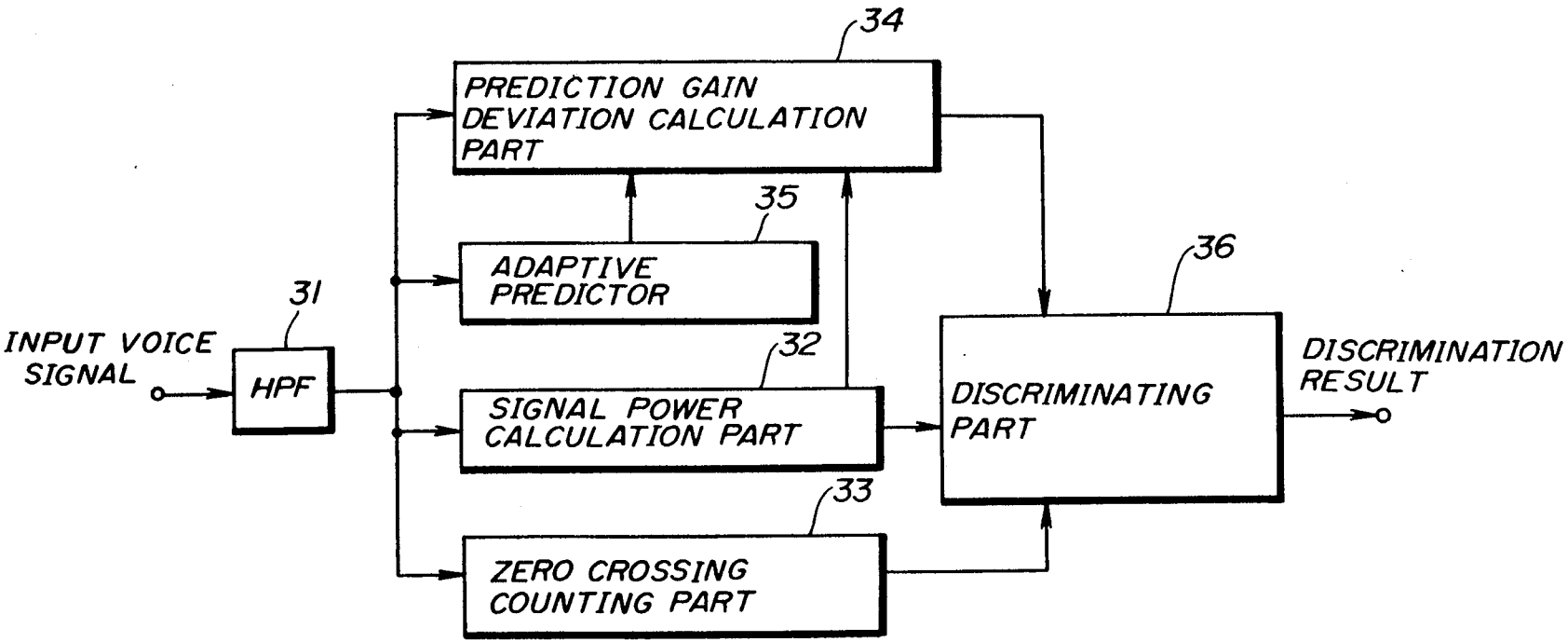
FIG. 11 is a system block diagram showing a third embodiment of the voice detection apparatus according to the present invention.

Next, a description will be given of a third embodiment of the voice detection apparatus according to the present invention, by referring to FIG. 11. A voice detection apparatus shown in FIG. 11 comprises a highpass filter 31, a signal power calculation part 32, a zero crossing counting part 33, a prediction gain deviation calculation part 34, an adaptive predictor 35 and a discriminating part 36.

An input voice signal which is subjected to an analog-to-digital conversion is supplied to the highpass filter 31 so as to eliminate a D.C. offset of the voice signal caused by the analog-to-digital conversion. The voice signal from the highpass filter 31 is supplied to the signal power calculation part 32, the zero crossing counting part 33, the prediction gain deviation calculation part 34 and the adaptive predictor 35. The voice signal is extracted at predetermined time intervals, that is, in frames or blocks, and a signal power P is calculated in the signal power calculation part 32, a number of zero crossing (zero crossing number) Z is counted in the zero crossing counting part 33, a prediction gain G and a prediction gain deviation D are calculated in the prediction gain deviation calculation part 34, and a prediction error E is calculated in the adaptive predictor 35. The zero crossing number is equivalent to the number of polarity inversions. The signal power P, the zero crossing number Z, the prediction gain G and the prediction gain deviation D are supplied to the discriminating part 36. The prediction error E is supplied to the prediction gain deviation calculation part 34.

The signal power calculation part 32 calculates the signal power P for an input voice frame. The zero crossing counting part 33 counts the zero crossing number Z (number of polarity inversions) and detects the frequency component of the input voice frame. The adaptive predictor 35 calculates the prediction error E of the input voice frame. The prediction gain deviation calculation part 34 calculates the prediction gain G and the prediction gain deviation D based on the signal power P and the predication error E of the input voice frame. The predication gain G can be obtained from the following formula.

$$G = -10\log_{10}[\Sigma E^2/P]$$

The prediction gain deviation D is a difference between the prediction gain G of a present frame (object frame) and the prediction gain G of a previous frame. The discriminating part 36 discriminates whether the present voice frame is voiced or silent based on the signal power P, the zero crossing number Z, the prediction gain deviation D and the like.

Figure 12:
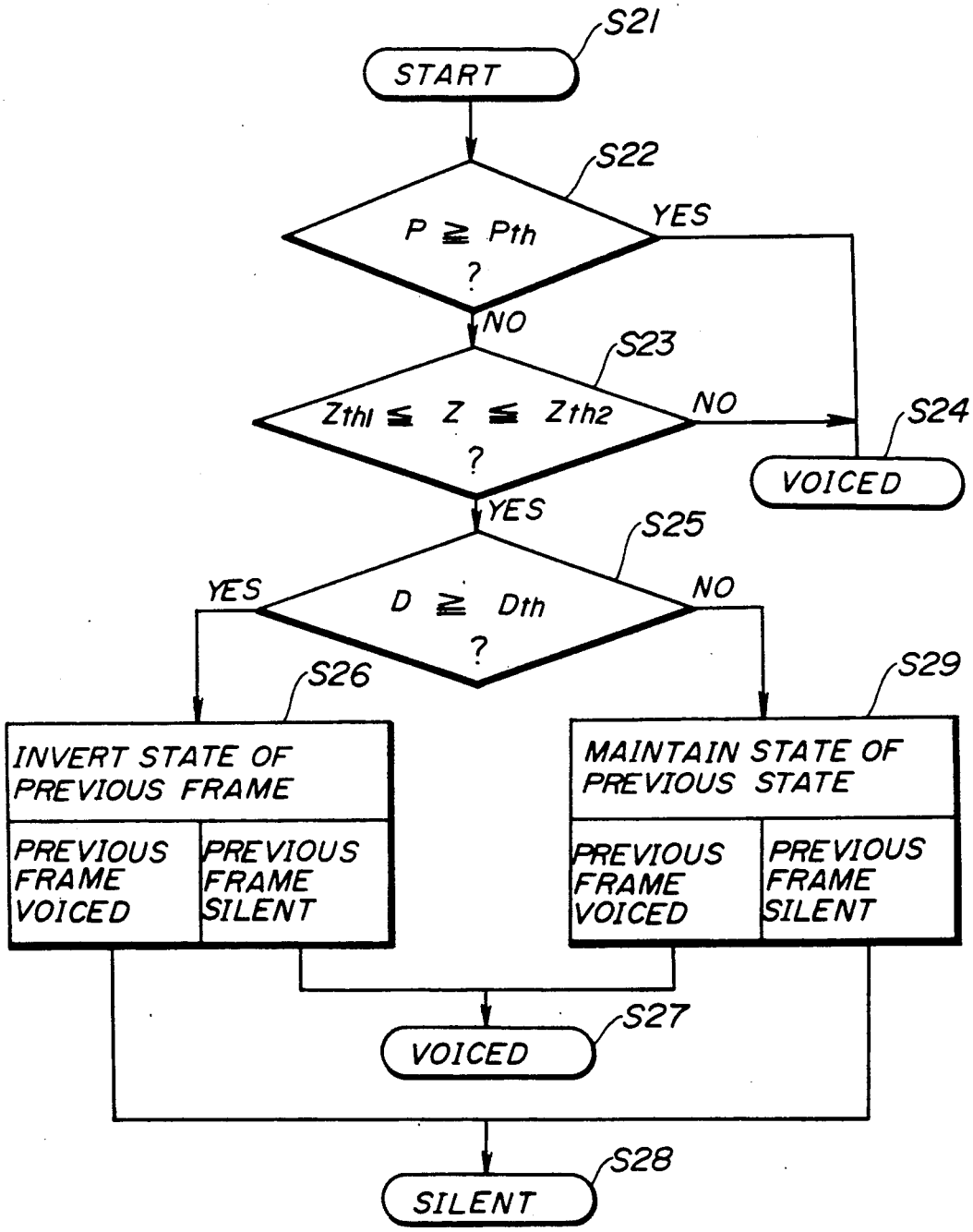
FIG. 12 is a flow chart for explaining an operation of a discriminating part of the third embodiment.

FIG. 12 shows an operation of the discriminating part 36 for discriminating the voiced/silent interval. When a discriminating operation is started in a step S21, a step S22 discriminates whether or not the signal power P of the input voice frame is greater than or equal to a predetermined threshold value $P_{th}$. When the discrimination result in the step S22 is YES, a step S24 detects that the input voice frame is voiced.

On the other hand, when the discrimination result in the step S22 is NO, a step S23 discriminates whether or not the zero crossing number Z is greater than or equal to a threshold value $Z_{th1}$ and is less than or equal to a threshold value $Z_{th2}$, so as to make a further discrimination on whether the input voice frame is voiced or silent. Generally, the voice signal has a low-frequency component and a high-frequency component in the voiced interval, and the voiced interval does not include much intermediate frequency component. On the other hand, noise includes all frequency components. For this reason, when the discrimination result in the step S23 is NO, the step S24 detects that the input voice frame is voiced.

When the discrimination result in the step S23 is YES, a step S25 discriminates whether or not the prediction gain deviation D is greater than or equal to a threshold value $D_{th}$, to as to make a further discrimination on whether the input voice frame is voiced or silent. Generally, the prediction gain G has a large value when the input voice frame is voiced and a small value when the input voice frame is silent such as the case of the noise. Accordingly, in a case where the previous frame is voiced and the prevent frame is silent or in a case where the previous frame is silent and the present frame is voiced, the prediction gain deviation D has a large value.

When the discrimination result in the step S25 is YES, it is detected that a transition occurred between the voiced and silent intervals. A step S26 obtains a state which is inverted with respect to the state of the previous frame. In other words, a voiced state is obtained when the previous frame is silent and a silent state is obtained when the previous frame is voiced. When the previous frame is silent, a step S27 detects that the input voice frame is voiced. On the other hand, when the previous frame is voiced, a step S28 detects that the input voice frame is silent.

When the discrimination result in the step S25 is NO, it is detected that no transition occurred between the voiced and silent intervals. A step S29 obtains a state which is the same as the state of the previous frame. In other words, a voiced state is obtained when the previous frame is voiced and a silent state is obtained when the previous frame is silent. When the previous frame is voiced, the step S27 detects that the input voice frame is voiced. On the other hand, when the previous frame is silent, the step S28 detects that the input voice frame is silent.

Therefore, it is possible to accurately discriminate whether the input voice signal corresponds to the voiced interval or the silent interval.

But when discriminating the voiced/silent interval based on the prediction gain deviation D and when the level of the background noise is large, the prediction gain deviation D between the present frame and the previous frame is small even when there is a transition from the voiced state to the silent state or vice versa. Accordingly, when the prediction gain deviation D is less than or equal to the threshold value $D_{th}$ under such conditions, the step S29 regards the voiced/silent state of the previous frame as the voiced/silent state of the present frame even when the state changes from the voiced state to the silent state or vice versa between the previous and present frames.

Next, a description will be given of a fourth embodiment of the voice detection apparatus according to the present invention, in which the voiced/silent state of the voice signal can be discriminated accurately even when the prediction gain deviation D is small so as to prevent the erroneous discrimination and improve the voice detection reliability.

Figure 13:
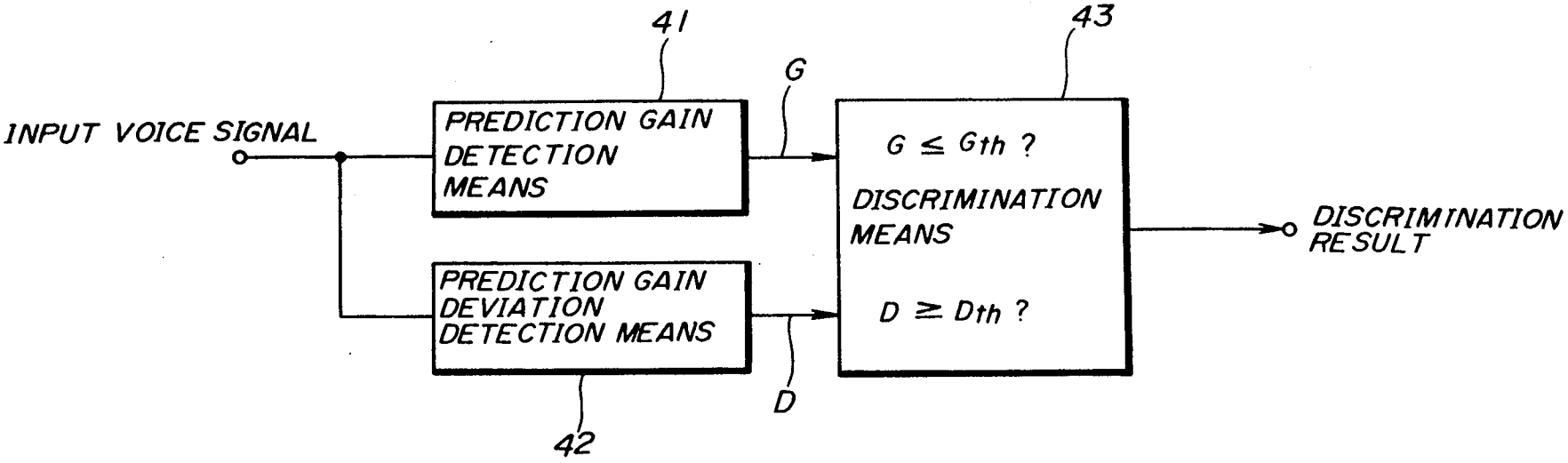
FIG. 13 is a system block diagram for explaining an operating principle of a fourth embodiment of the voice detection apparatus according to the present invention.

First, a description will be given of an operating principle of the fourth embodiment, by referring to FIG. 13. A voice detection apparatus shown in FIG. 13 generally comprises a prediction gain detection means 41, a prediction gain deviation detection means 42 and a discrimination means 43. The input voice signal is successively divided into processing frames, and the voiced/silent interval is discriminated in units of frames.

The prediction gain detection means 41 detects a prediction gain G of the present frame. The prediction gain deviation detection means 42 detects a prediction gain deviation D between the present frame and the previous frame. The discrimination means 43 discriminates whether the present frame is a voiced interval or a silent interval based on a comparison of the prediction gain G with a threshold value $G_{th}$ and a comparison of the prediction gain deviation G with a threshold value $D_{th}$.

With respect to the present frame which is discriminated as the silent interval based on the prediction gain deviation D, the discrimination means 43 makes a further discrimination of the voiced/silent state of this present frame based on the prediction gain G. In addition, with respect to the present frame which is discriminated as the voiced interval based on the prediction gain G, the discrimination means 43 makes a further discrimination of the voiced/silent state of this present frame based on the prediction gain deviation D.

For example, the discrimination means 43 first discriminates the voiced/silent state based on whether or not the prediction gain deviation D is greater than or equal to the threshold value $D_{th}$, and when the discrimination result is the silent state, the discrimination result is corrected by discriminating the voiced/silent state based on whether or not the prediction gain G is greater than or equal to the threshold value $G_{th}$. As an alternative, the discrimination means 43 first discriminates the voiced/silent state based on whether or not the prediction gain G is greater than or equal to the threshold value $G_{th}$, and when the discrimination result is the voiced state, the discrimination result is corrected by discriminating the voiced/silent state based on whether or not the prediction gain deviation D is greater than or equal to the threshold value $D_{th}$.

Next, a more detailed description will be given of the fourth embodiment, by referring to FIGS. 14A and 14B. In this embodiment, it is possible to use the block system of the third embodiment shown in FIG. 11 but the operation of the discriminating part 36 is as shown in FIGS. 14A and 14B.

Figures 14A, 14B:
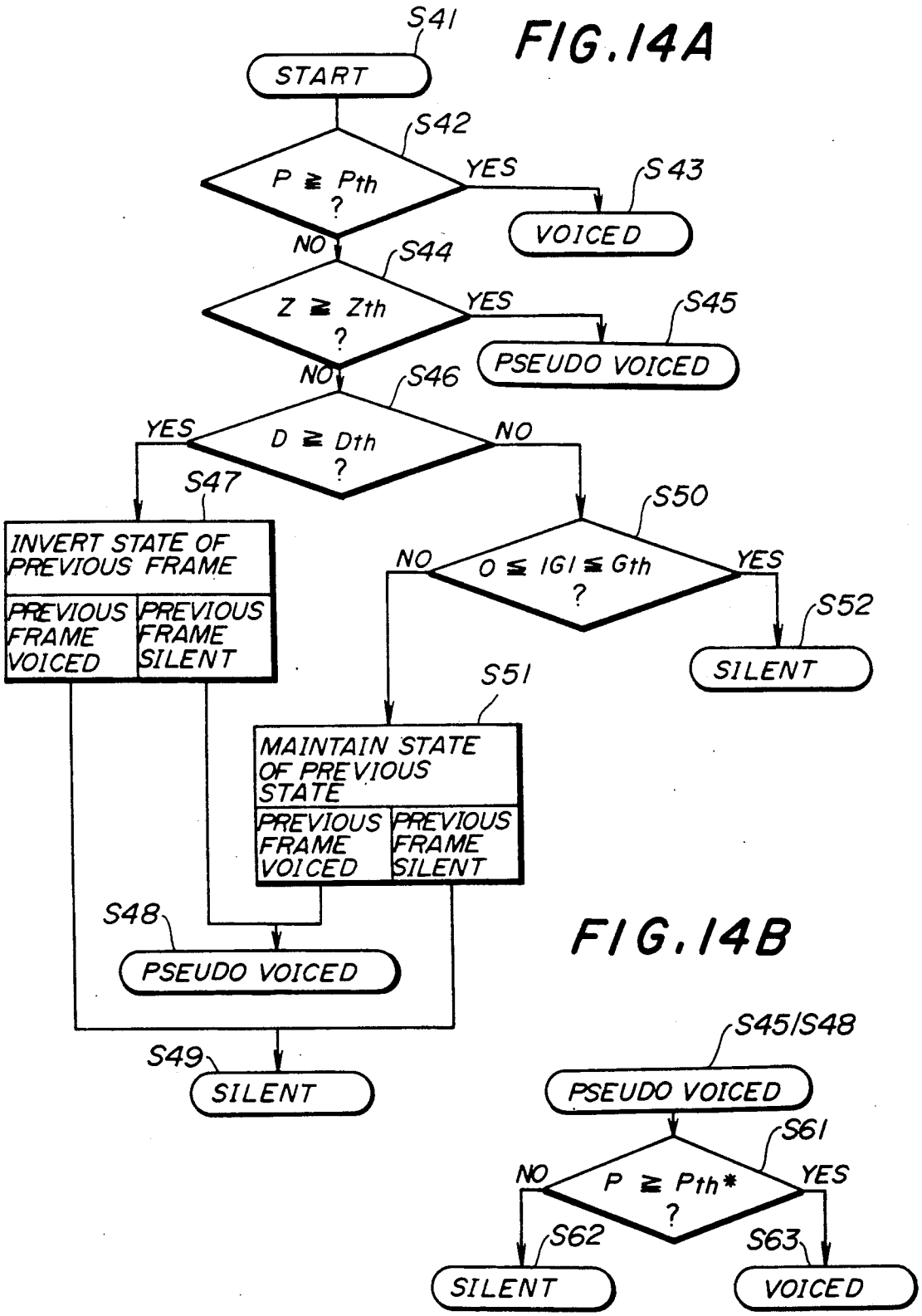
FIGS. 14A and 14B respectively are flow charts for explaining an operation of the discriminating part of the fourth embodiment.

When a discriminating operation is started in a step S41 shown in FIG. 14A, a step S42 discriminates whether or not the signal power P of the input voice frame is greater than or equal to a predetermined threshold value $P_{th}$. When the discrimination result in the step S42 is YES, a step S43 detects that the input voice frame is voiced.

On the other hand, when the discrimination result in the step S42 is NO, a step S44 discriminates whether or not the zero crossing number Z is greater than or equal to a threshold value $Z_{th}$ so as to make a further discrimination on whether the input voice frame is voiced or silent. When the discrimination result in the step S44 is YES, a step S45 detects that the input voice frame is a pseudo voiced interval.

FIG. 14B shows the step S45. A step S61 discriminates whether or not the signal power P of the input voice signal is greater than or equal to a threshold value $P_{th*}$. When the discrimination result in the step S61 is NO, a step S62 detects the silent interval. On the other hand, when the discrimination result in the step S61 is YES, a step S63 detects the voiced interval The threshold value $P_{th*}$ is used to forcibly discriminate the silent interval when the signal power P is in the order of the idle channel noise and small, even when the input voice frame is once discriminated as the voiced interval. Hence, this threshold value $P_{th*}$ is set to an extremely small value so that the silent state of the input voice frame can absolutely be discriminated.

When the discrimination result in the step S44 is NO, a step S46 discriminates whether or not the prediction gain deviation D is greater than or equal to a threshold value $D_{th}$, to as to make a further discrimination on whether the input voice frame is voiced or silent. When the discrimination result in the step S46 is YES, it is detected that a transition occurred between the voiced and silent intervals. A step S47 obtains a state which is inverted with respect to the state of the previous frame. In other words, a voiced state is obtained when the previous frame is silent and a silent state is obtained when the previous frame is voiced. When the previous frame is silent, a step S48 detects that the input voice frame is pseudo voiced and the process shown in FIG. 14B is carried out. On the other hand, when the previous frame is voiced, a step S49 detects that the input voice frame is silent.

When the discrimination result in the step S46 is NO, a step S50 discriminates whether or not an absolute value of the prediction gain G is greater than or equal to zero and is less than or equal to a threshold value $G_{th}$. As described above, when the background noise is large, the prediction gain deviation D may be smaller than the threshold value $D_{th}$ even when there is a transition from the voiced state to the silent state or vice versa. However, the absolute value of the prediction gain G itself has a large value for the voiced signal and a small value for the noise. For this reason, a step S52 detects the silent interval when the discrimination result in the step S50 is YES. On the other hand, when the discrimination result in the step S50 is NO, a step S51 obtains a state which is the same as the state of the previous frame. In other words, a voiced state is obtained when the previous frame is voiced and a silent state is obtained when the previous frame is silent. When the previous frame is voiced, the step S48 detects that the input voice frame is pseudo voiced. On the other hand, when the previous frame is silent, the step S49 detects that the input voice frame is silent.

Various modifications of the fourth embodiment are possible. When discriminating the voiced/silent state by use of the prediction gain deviation and the prediction gain in the fourth embodiment, the voiced/silent state is first discriminated from the prediction gain deviation. And when the discrimination cannot be made, the voiced/silent state is further discriminated by us of the absolute value of the prediction gain. But for example, it is possible to first discriminate the voiced/silent state from the prediction gain and then discriminate the voiced/silent state from the prediction gain deviation when the voiced state is discriminated by the first discrimination.

In addition, it is not essential to use the four parameters (input voice signal power, zero crossing number, prediction gain and prediction gain deviation) for making the voice detection in the fourth embodiment. For example, only one of the input voice signal power and the zero crossing number may be used in a modification of the fourth embodiment.

Further, the present invention is not limited to these embodiments, but various variations and modifications may be made without departing from the scope of the present invention.

What is claimed is:

1. A voice detection apparatus comprising:

signal power calculation means for receiving an input voice signal that comprises a plurality of frames and has voiced and silent intervals and for calculating a signal power of the input voice signal for each of the frames;

zero crossing counting means for counting a number of polarity inversions of the input voice signal for each of the frames;

adaptive prediction filter means for obtaining a prediction error signal of the input voice signal for each of the frames;

error signal power calculation means for calculating an error signal power of the prediction error signal for each of the frames;

power comparing means for comparing the signal power of the input voice signal and the error signal power of the prediction error signal and for obtaining a power ratio responsive to the comparing; and discriminating means for discriminating the voiced and silent intervals based on the signal power, the counted number of polarity inversions and the power ratio, said discriminating means including:

first means for discriminating the voiced and silent intervals of the input voice signal based on the counted number of polarity inversions, and second means for determining an absolute value of a difference of the power ratios between the frames, and for discriminating whether a frame is a voiced interval or a silent interval depending on a comparison of the absolute value with a first threshold value and whether a previous frame is a voiced interval or a silent interval when the signal power of the input voice signal is less than a second threshold value.

2. The voice detection apparatus as claimed in claim 1, further comprising:

means for sampling the input voice signal, and wherein said signal power calculation means includes means for calculating the signal power of the input voice signal based on $$SP = (1/N) \sum_{i=1}^{n} x_i^2,$$

where SP denotes the signal power, n denotes a number of the samples, $X_i$ denotes sectioning the input voice signal at predetermined time intervals and N denotes a number of the frames obtained from the sectioning of the input voice signal at the predetermined time intervals.

3. The voice detection apparatus as claimed in claim 1, wherein said error signal power calculation means includes means for calculating the signal power of the prediction error signal.

4. The voice detection apparatus as claimed in claim 1, wherein said zero crossing counted means comprises:

high pass filter means for filtering the input voice signal and for providing a first output signal having a polarity;

polarity detection means for detecting the polarity of the first output signal and for providing a second output signal;

delay means for delaying the second output signal and for providing a third output signal;

polarity inversion detection means for detecting a polarity inversion of the first output signal based on the second output signal and the third output signal, and for providing a fourth output signal; and counter means for counting a number of polarity inversion based on the fourth output signal, said counter being reset for every frame of the input voice signal.

5. The voice detection apparatus as claimed in claim 1, wherein said adaptive prediction filter comprises a linear prediction filter.

6. The voice detection apparatus a claimed in claim 5, which further comprises:

linear prediction analyzer means for obtaining a prediction coefficient for use by said linear prediction filter based on the input voice signal.

7. The voice detection apparatus as claimed in claim 5, which further comprises:

linear prediction analyzer means for analyzing data of a previous frame to obtain a prediction coefficient based on the input voice signal.

8. A voice detection apparatus comprising:

signal power calculation means for receiving an input voice signal that comprises a plurality of frames and has voiced and silent intervals and for calculating a signal power of the input voice signal for each of the frames;

zero crossing counting means for counting a number of polarity inversions of the input voice signal for each of the frames;

prediction gain deviation calculation means for calculating a prediction gain and a prediction gain deviation between frames based on the input voice signal and the signal power calculated in said signal power calculation means; and discriminating means for discriminating the voiced and the silent intervals based on the signal power, the counted number of polarity inversions and the prediction gain and the prediction gain deviation, said discriminating means including:

first means for discriminating the voiced and silent intervals of the input voice signal based on when the signal power is greater than or equal to a first threshold value and the counted number of polarity inversions falls outside a predetermined range of a second threshold value, and second means for discriminating the voiced and silent intervals of the voice signal based on a comparison of the prediction gain deviation and a third threshold value when the signal power is less than the first threshold value and the counted number of polarity inversions falls within the predetermined range of the second threshold value.

9. The voice detection apparatus as claimed in claim 8, wherein said second means includes means for detecting a frame as a voiced interval when the prediction gain deviation is greater than or equal to the third threshold value and a previous frame is a silent interval and when the prediction gain is less than the third threshold value and the previous frame is a voiced interval, and for detecting the present frame as a silent interval when the prediction gain deviation is greater than or equal to the third threshold value and the previous frame is a voiced interval and when the prediction gain is less than the third threshold value and the previous frame is a silent interval.

10. The voice detection apparatus as claimed in claim 8, wherein said prediction gain deviation calculation means includes:

adaptive predictor means for calculating a prediction error for each of the frames.

11. The voice detection apparatus as claimed in claim 10, wherein said prediction gain deviation calculation means includes means for calculating the prediction gain based on $G = -10\log_{10}[\Sigma E^2/P]$, where G denotes the prediction gain, P denotes the signal power and E denotes the prediction error.

12. A voice detection apparatus for detecting voiced and silent intervals of an input voice signal that comprises a plurality of frames and has voiced and silent intervals, said voice detection apparatus comprising:

prediction gain detection means for receiving the input voice signal and for detecting a prediction gain for a frame of the input voice signal;

prediction gain deviation detection means for receiving the input voice signal and for detecting a prediction gain deviation between frames; and discriminating means for performing a first comparison of the prediction gain with a first threshold value and a second comparison of the prediction gain deviation with a second threshold value and for discriminating whether one of the frames of the input voice signal is a voiced interval or a silent interval based on the first and second comparisons.

13. The voice detection apparatus as claimed in claim 12, wherein said discriminating means includes:

means for discriminating whether or not the frame of the input voice signal is a voiced interval or a silent interval based on the prediction gain and when the frame is first discriminated as a silent interval using the prediction gain deviation.

14. The voice detection apparatus as claimed in claim 12, wherein said discriminating means includes means for discriminating whether or not a frame of the input voice signal is a voiced interval or a silent interval based on the prediction gain deviation when the frame is first discriminated as a silent interval using the prediction gain.

15. The voice detection apparatus as claimed in claim 12, wherein the input voice signal has a signal power, and the voice detection apparatus further comprises:

signal power calculation means for receiving the input voice signal and for calculating the signal power of the input voice signal;

zero crossing means for receiving the input signal and for counting a number of polarity inversions of the input voice signal; and said discriminating means includes means for discriminating whether or not the frame is a voiced interval or a silent interval based on the signal power and the counted number of polarity inversions when the signal power and the counted number of polarity inversions is less than or equal to corresponding third and fourth threshold values.

16. The voice detection apparatus as claimed in claim 15, wherein said discriminating means includes:

means for discriminating whether or not the frame is a voiced interval or a silent interval only when at least one of the signal power and the number of polarity inversions are greater than the corresponding third and fourth threshold values.

17. The voice detection apparatus as claimed in claim 10, wherein said prediction gain deviation detection means comprises a linear prediction filter.

18. The voice detection apparatus as claimed in claim 17, which further comprises:

linear prediction analyzer means for obtaining a prediction coefficient for use by said linear prediction filter based on the input voice signal.

19. The voice detection apparatus as claimed in claim 17, which further comprises:

linear prediction analyzer means for analyzing data of the previous frame and for obtaining a prediction coefficient for use by said linear prediction filter based on the input voice signal.

* * * * *

UNITED STATES PATENT AND TRADEMARK OFFICE

CERTIFICATE OF CORRECTION

PATENT NO. : 5,103,481

DATED : April 7, 1992

INVENTOR(S) : Iseda et al.

It is certified that error appears in the above-identified patent and that said Letters Patent is hereby corrected as shown below:

Col. 2, line 30, after "while" insert --adaptive--;
line 34, change "an" to --and--.

Col. 3, line 35, change "while" to --and--; change "and" to --while--;
line 53, delete "cl BRIEF DESCRIPTION OF";
line 54, before "THE" insert --BRIEF DESCRIPTION OF--.

Col. 7, line 11, change "designed" to --designated--;
line 44, change "crossing" to --crossings--.

Col. 12, line 34 (claim 4), change "inversion" to --inversions--;
line 40 (claim 6), change "a" to --as--.

Signed and Sealed this

Twenty-eighth Day of September, 1993

Bruce Lehman

*Attest:*

BRUCE LEHMAN

*Attesting Officer*

*Commissioner of Patents and Trademarks*